US011547172B2

(12) United States Patent
Yang

(10) Patent No.: US 11,547,172 B2
(45) Date of Patent: Jan. 10, 2023

(54) SIZE ADJUSTABLE FOOTWEAR

(71) Applicant: Mary Yang, Menomonee Falls, WI (US)

(72) Inventor: Mary Yang, Menomonee Falls, WI (US)

( * ) Notice: Subject to any disclaimer, the term of this patent is extended or adjusted under 35 U.S.C. 154(b) by 6 days.

(21) Appl. No.: 17/139,699

(22) Filed: Dec. 31, 2020

(65) Prior Publication Data

US 2021/0204639 A1 Jul. 8, 2021

Related U.S. Application Data

(60) Provisional application No. 62/957,601, filed on Jan. 6, 2020.

(51) Int. Cl.
*A43B 3/26* (2006.01)

(52) U.S. Cl.
CPC ..... *A43B 3/26* (2013.01)

(58) Field of Classification Search
CPC ..... A43B 3/26
USPC ..... 36/97, 136
See application file for complete search history.

(56) References Cited

U.S. PATENT DOCUMENTS 922,499 A * 5/1909 Molitor ..... A43B 3/0031 36/1
3,389,481 A * 6/1968 England ..... A43B 3/26 36/97
3,541,708 A * 11/1970 Elliott ..... A43B 3/14 36/97
3,686,777 A * 8/1972 Rosen ..... A43B 3/26 36/97
5,490,338 A * 2/1996 Hwang ..... A43B 3/36 36/137
2002/0069557 A1* 6/2002 Miller ..... A43B 23/24 36/97
2003/0097770 A1* 5/2003 Karasawa ..... A43B 3/06 36/97
2003/0106244 A1* 6/2003 Miller ..... A43B 23/24 36/97
2004/0107604 A1* 6/2004 Ha ..... A43B 3/26 36/97
2005/0115113 A1* 6/2005 Miller ..... A43B 3/26 36/97
2005/0115114 A1* 6/2005 Miller ..... A43B 3/26 36/97
2006/0130371 A1 6/2006 Schneider
(Continued)

FOREIGN PATENT DOCUMENTS

JP 4001597 B2 2/2006
KR 200483055 Y1 3/2017

*Primary Examiner* — Marie D Bays

(57) ABSTRACT

A size adjustable footwear includes an upper, an insole, a midsole, an outer sole, and a size adjustment mechanism. The midsole includes a heel plate and a toe plate. The upper is perimetrically connected around the midsole. The insole is adjacently connected atop the midsole and internally positioned within the upper. The outer sole is perimetrically connected around the midsole as the midsole is positioned in between the insole and the outer sole. The heel plate and the toe plate are slidably engaged to the size adjustment mechanism. The size adjustment mechanism is operatively integrated in between the heel plate and the toe plate, wherein the size adjustment mechanism elastically expands and contracts the upper, the midsole, and the outer sole.

7 Claims, 10 Drawing Sheets

(56) References Cited

U.S. PATENT DOCUMENTS

| | | | | |
|---|---|---|---|---|
| 2006/0230638 | A1* | 10/2006 | Cavasin | A43B 3/26 36/117.3 |
| 2006/0230640 | A1* | 10/2006 | Chen | A43B 5/06 36/136 |
| 2008/0296871 | A1* | 12/2008 | Hsieh | A63C 1/26 280/607 |
| 2009/0249655 | A1* | 10/2009 | Portnell | A43B 3/0031 36/11.5 |
| 2011/0047826 | A1* | 3/2011 | Rosen | A43B 23/07 36/97 |
| 2012/0304496 | A1* | 12/2012 | Rosen | A43B 3/26 36/97 |
| 2013/0333244 | A1* | 12/2013 | Rosen | A43B 3/26 36/97 |
| 2015/0366288 | A1 | 12/2015 | Miller | |
| 2020/0375301 | A1* | 12/2020 | Cheung | A43B 3/26 |

* cited by examiner

SIZE ADJUSTABLE FOOTWEAR

The current application claims a priority to the U.S. Provisional Patent application Ser. No. 62/957,601 filed on Jan. 6, 2020.

FIELD OF THE INVENTION

The present invention generally relates to expandable and adjustable footwear. More specifically, the present invention provides footwear that can be expanded or contracted to adjust to the user's changing foot size.

BACKGROUND OF THE INVENTION

Finding the right shoe size can be a daunting task due to various reasons. The growing feet of toddlers and children changes rapidly as they develop making it problematic and tiresome for parents as they end up spending a lot of money buying shoes that their children will outgrow after a couple of months. Multiple people also often have one foot that is larger than the other forcing them to wear different shoe sizes. Furthermore, the size of one's feet may change over time due to aging, trauma, or medical conditions. The present invention addresses all the above issues adequately. The present invention allows people to extend or shorten the length of a footwear as needed to accommodate the changes in feet size over time.

The present invention provides adjustable inner and outer soles that can expand and contract simultaneously, or one at a time if necessary. The size adjustable mechanism can utilize different mechanisms powered by one or more dials, bars, rods, a set of guides, springs, flexible structure, etc. The size adjustable mechanism is preferably integrated into the inner sole and hidden from the external environment to not affect the ornamental look of the footwear. The outer sole is a casing made from rubber stretchable material to receive the inner sole and to hold/stabilize the overall structure of the inner sole during the contraction and the extension of the size adjustable mechanism. The inner sole comprises multiple sections (ex: insole and midsole) connected by the size adjustable mechanism which can be pushed away from each other or pulled together to adjust the overall size of the footwear. Further, the size adjustable mechanism is preferably manually operated and easily accessible to the user.

DETAIL DESCRIPTIONS OF THE INVENTION

All illustrations of the drawings are for the purpose of describing selected versions of the present invention and are not intended to limit the scope of the present invention.

Figure 1:
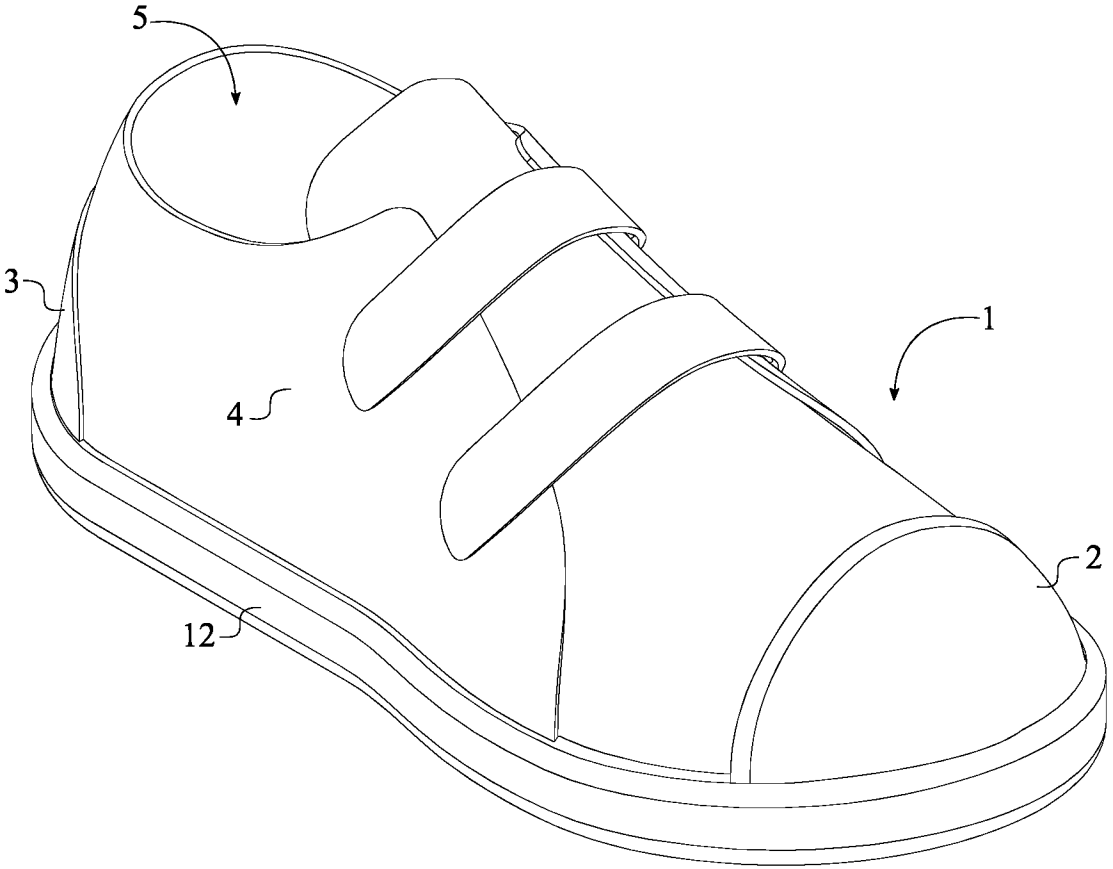
FIG. 1 is a perspective view of the present invention.
Figure 2:
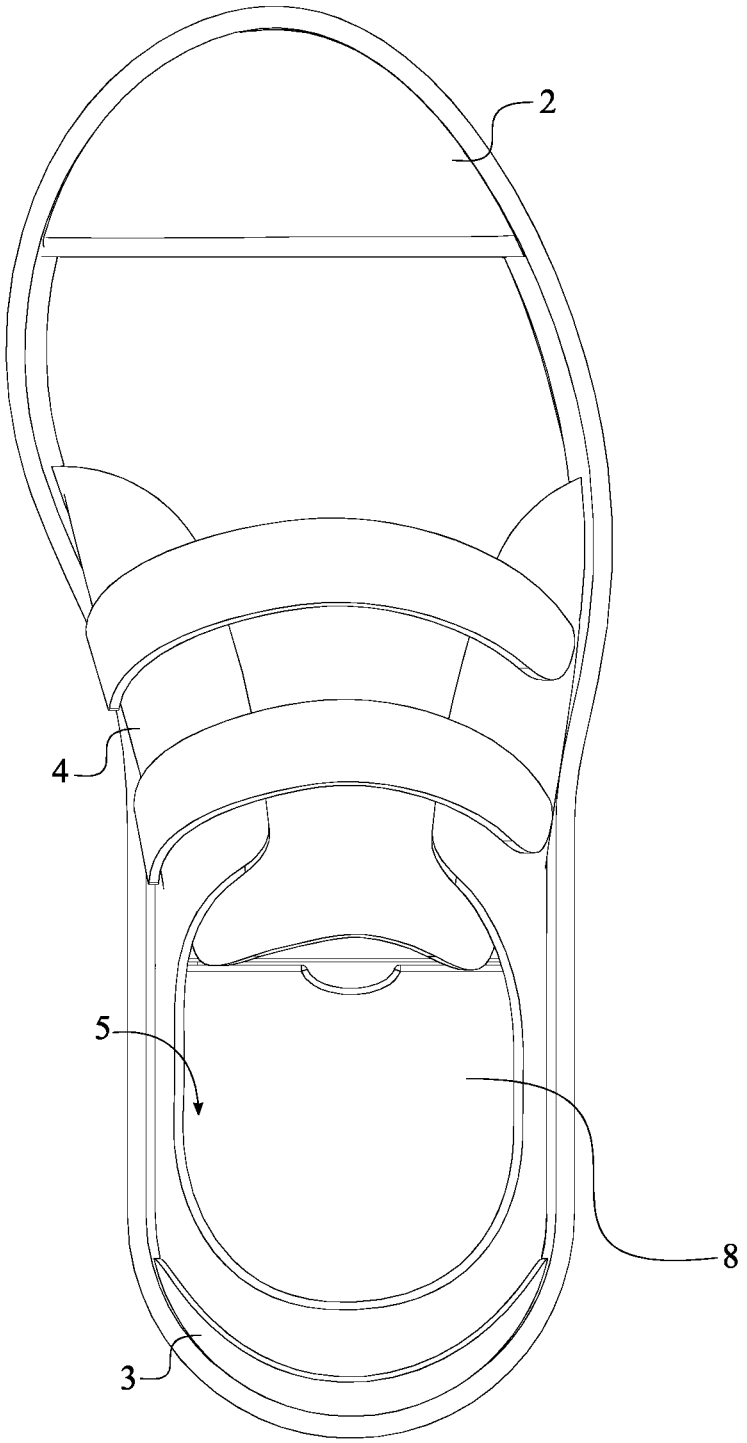
FIG. 2 is a top view of the present invention.
Figure 3:
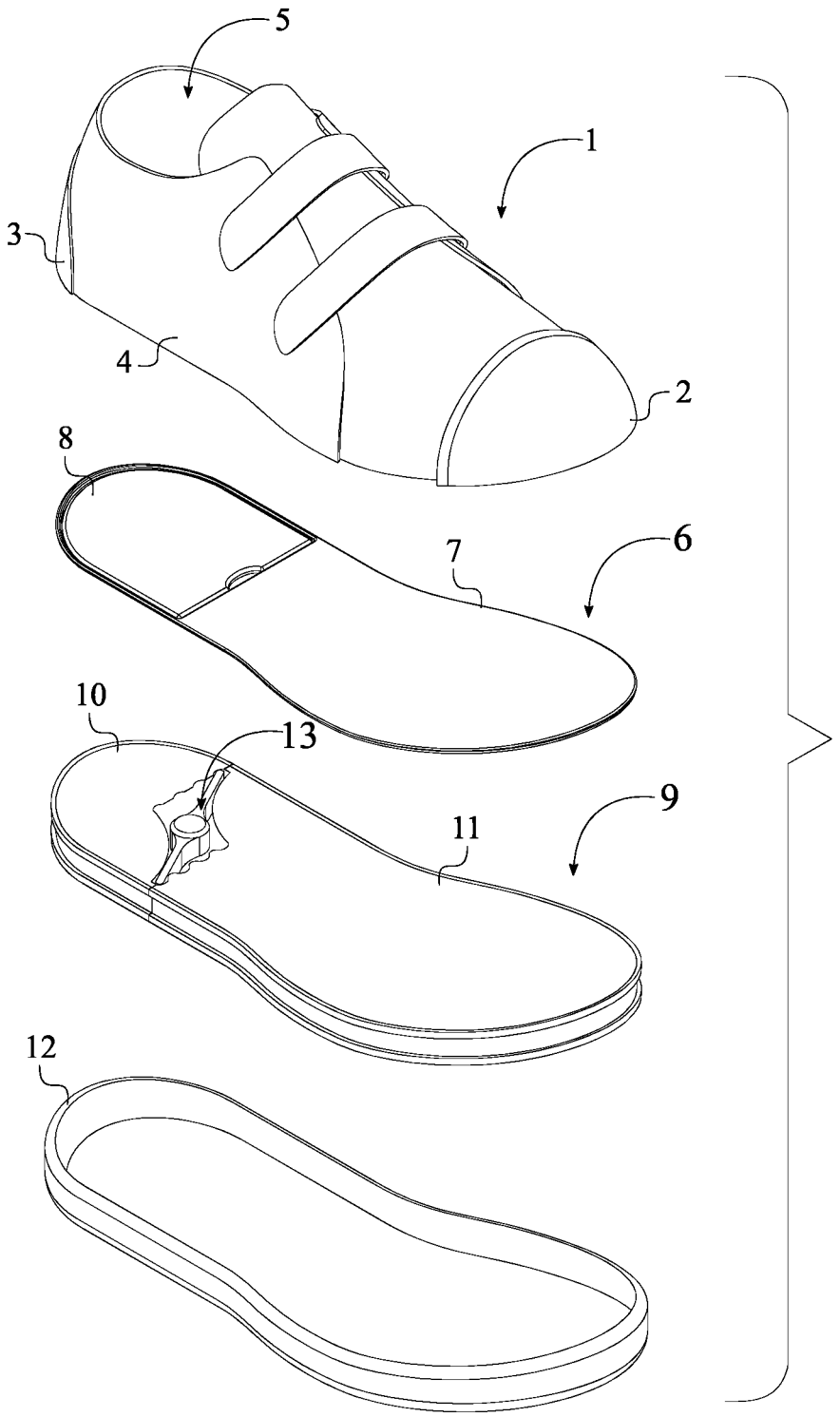
FIG. 3 is an exploded view of the present invention, showing the upper, insole, midsole, outer sole, and the size adjustment mechanism.
Figure 7:
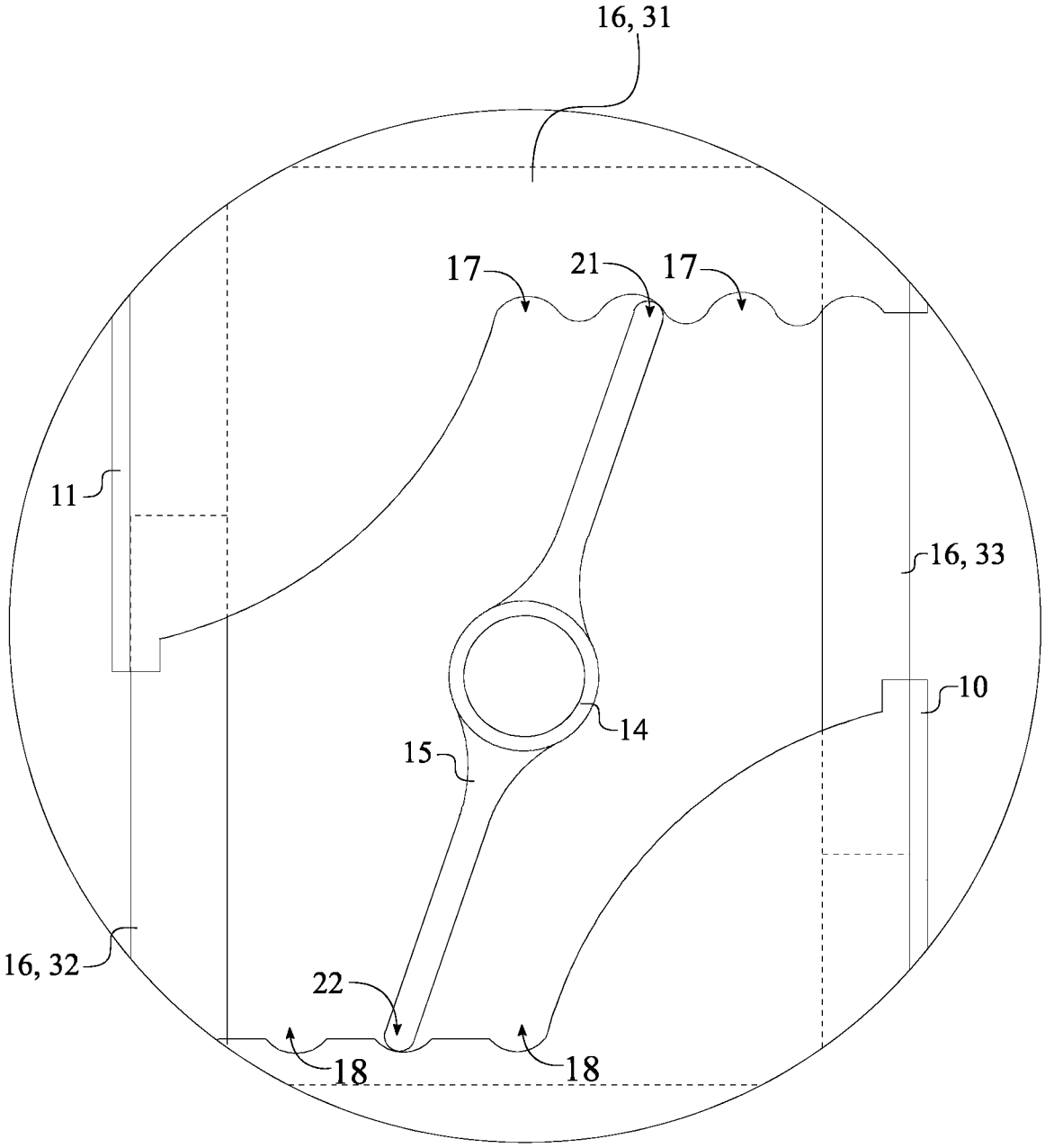
FIG. 7 is a top detailed view of the midsole and the size adjustment mechanism of the present invention, wherein the size adjustment mechanism is at the second expanded configuration.
Figure 8:
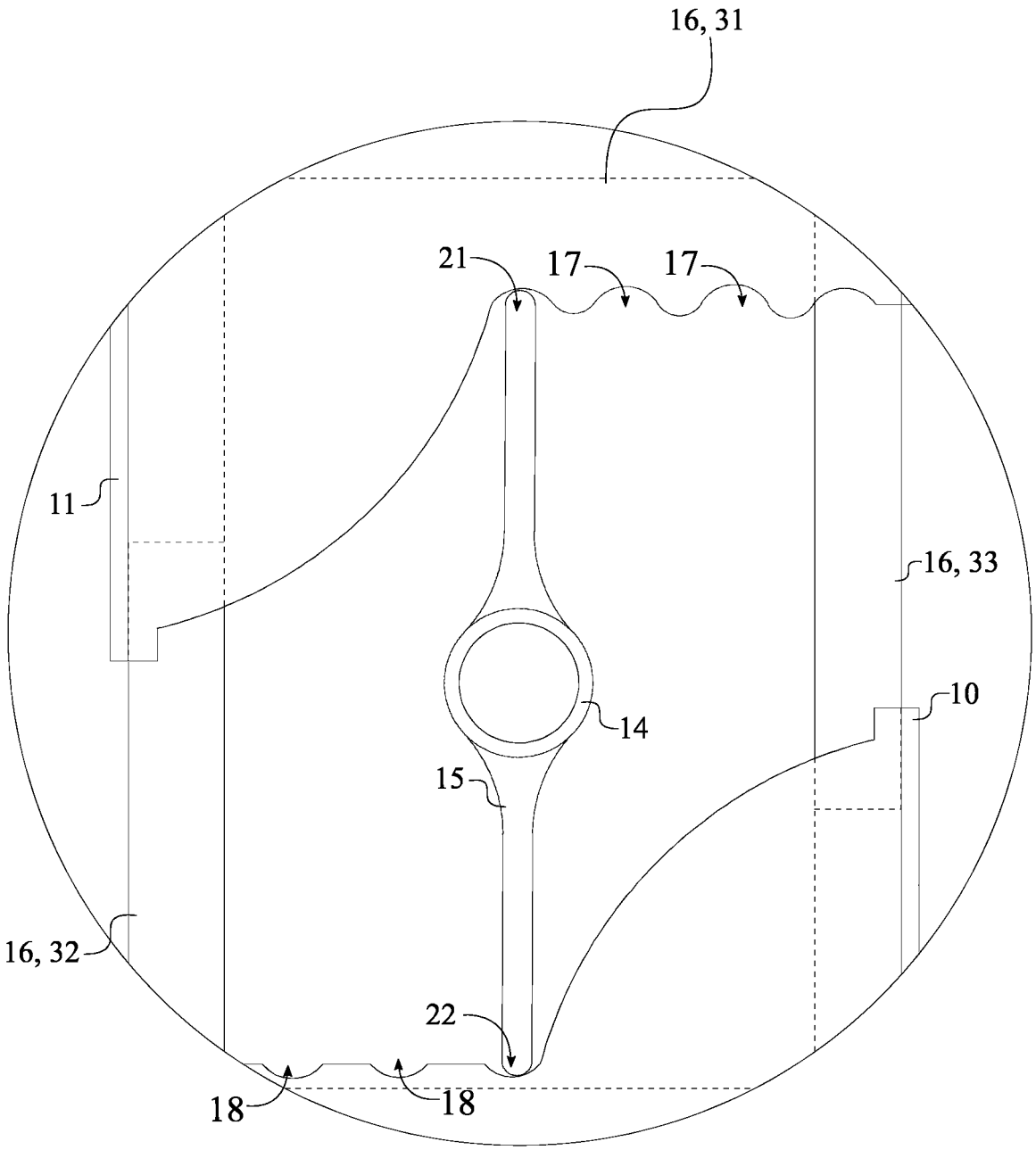
FIG. 8 is a top detailed view of the midsole and the size adjustment mechanism of the present invention, wherein the size adjustment mechanism is at the first expanded configuration.
Figure 9:
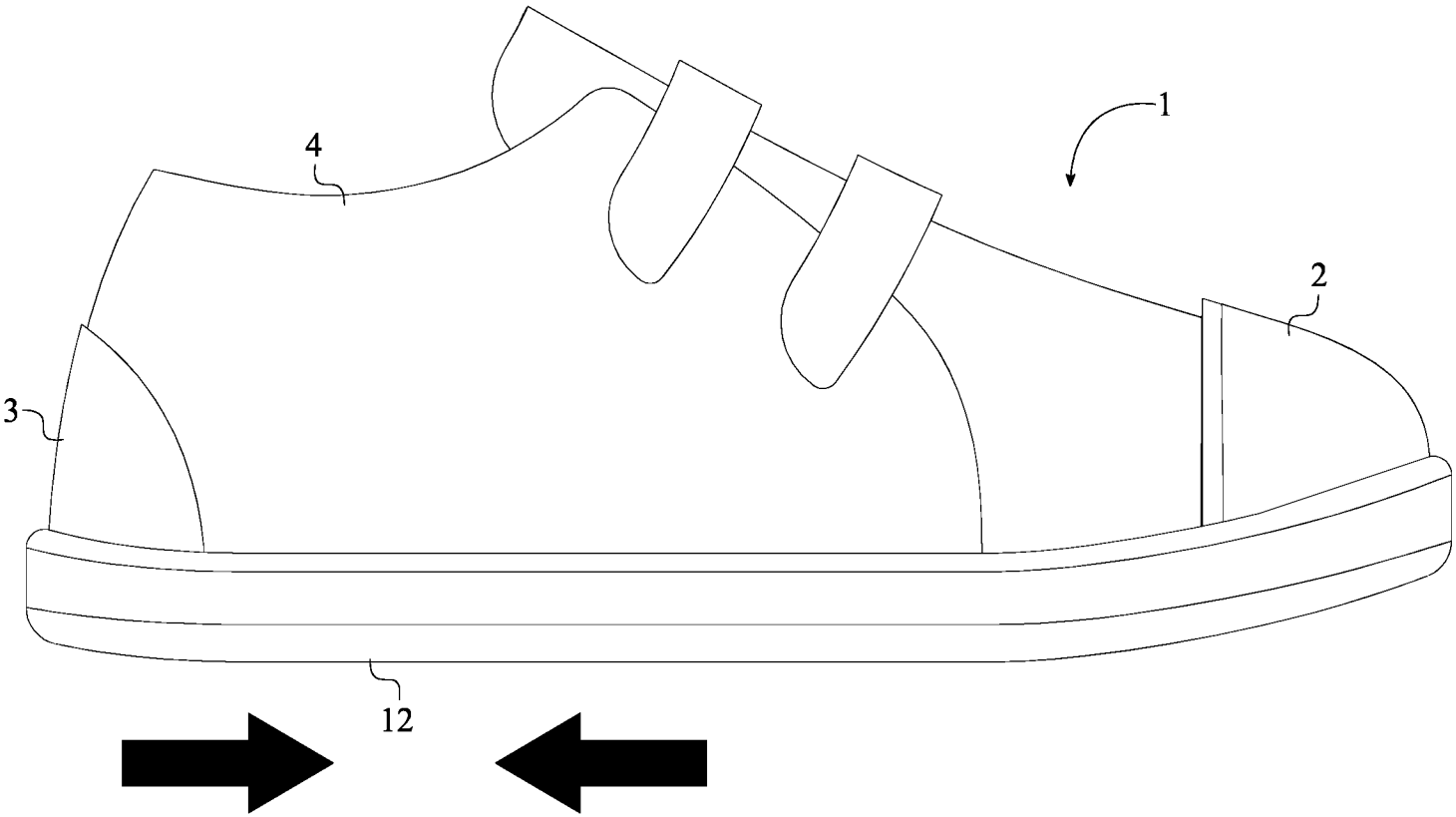
FIG. 9 is a side view of the present invention, wherein the present invention is contracted.
Figure 10:
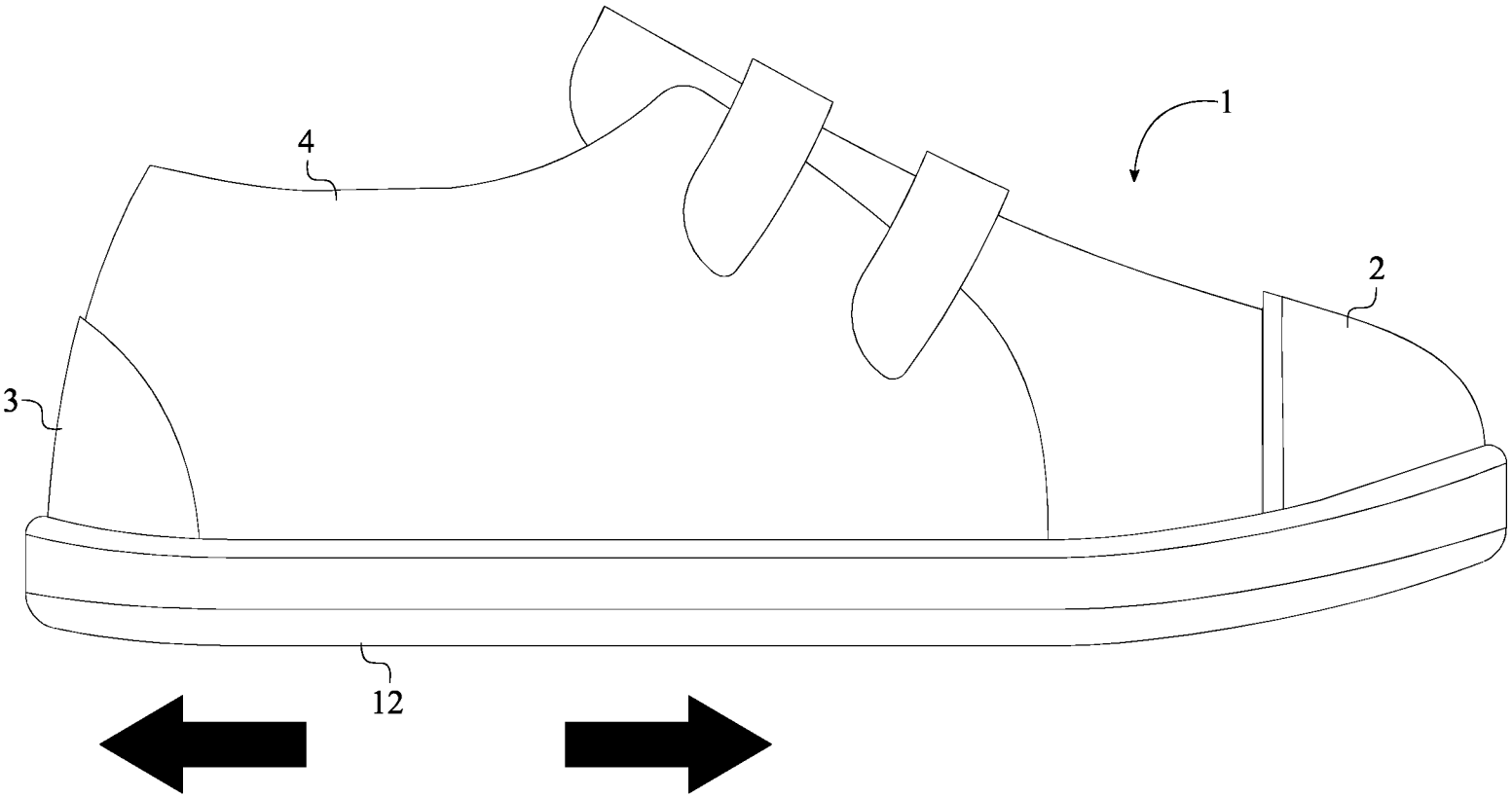
FIG. 10 is a side view of the present invention, wherein the present invention is expanded.

The present invention provides expandable and adjustable footwear, particularly shoes which can be customized to adjust to the size of feet of infants, children, adults, or the like. The present invention provides a sole structure that can be expanded or contracted as needed to match the user's changing foot size as shown in FIG. 9-10. In the preferred embodiment, the present invention comprises an upper 1, an insole 6, a midsole 9, an outer sole 12, and a size adjustment mechanism 13 as shown in FIG. 1-3. In order to facilitate the expansion and contraction of the present invention, the midsole 9 comprises a heel plate 10 and a toe plate 11 as shown in FIG. 3-8.

In reference to the general configuration of the present invention, the upper 1 that covers the upper part of the user's foot is perimetrically connected around the midsole 9. The insole 6 that protects the bottom part of the user's foot is adjacently connected atop the midsole 9 and internally positioned within the upper 1. The outer sole 12 being perimetrically connected around the midsole 9 thus positioning the midsole 9 in between the insole 6 and the outer sole 12. The heel plate 10 and the toe plate 11 are slidably engaged to the size adjustment mechanism 13 that facilitates the manual expansion and contraction of the present invention as necessary. In other words, the size adjustment mechanism 13 is operatively integrated in between the heel plate 10 and the toe plate 11 so that the size adjustment mechanism 13 can elastically expand and contract the upper 1, the insole 6, the midsole 9, and the outer sole 12.

Figure 4:
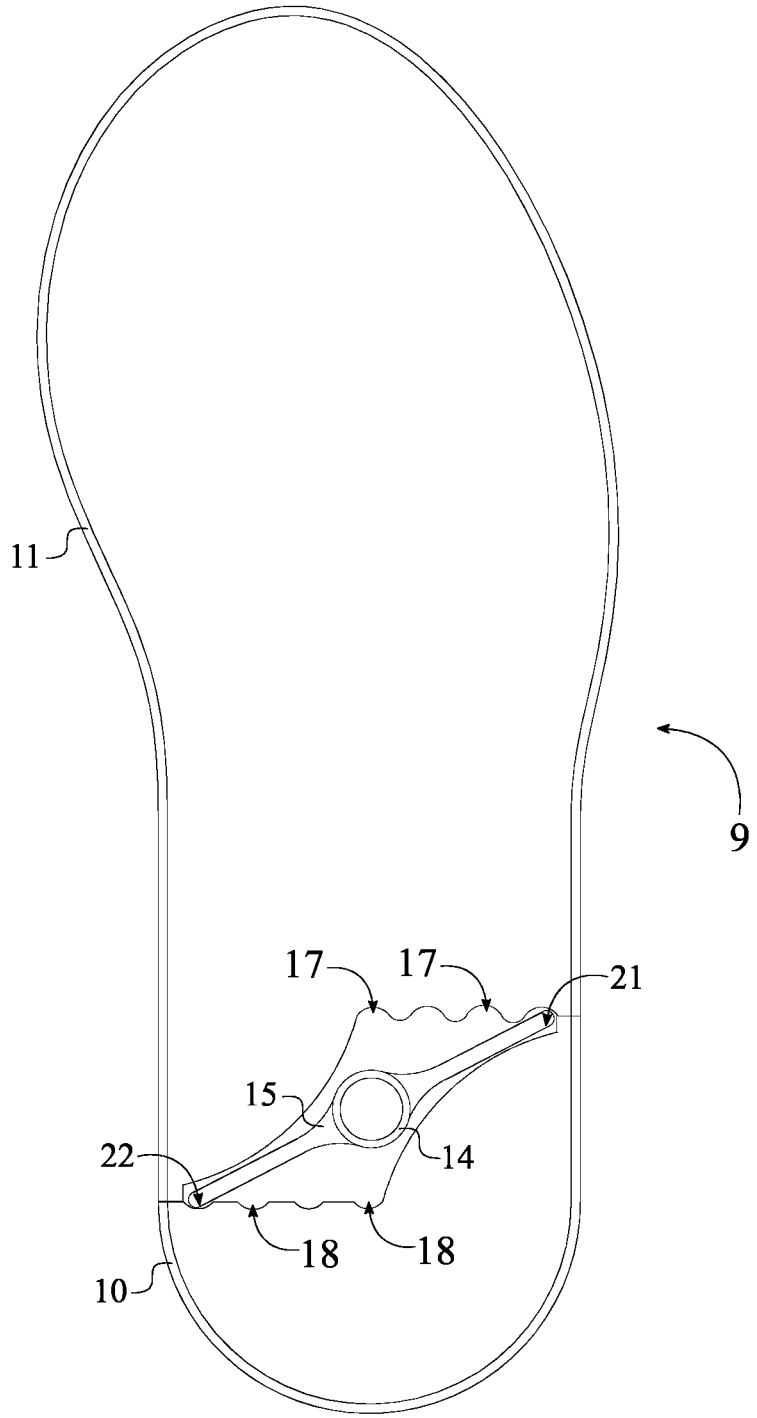
FIG. 4 is a top view of the midsole and the size adjustment mechanism of the present invention.

In reference to FIG. 1 and FIG. 3-4, the toe plate 11 is a rigid body and positioned under the user's foot when the present invention is worn. The toe plate 11 generally covers the sole, instep, and the arch of the user's foot. The heel plate 10 is rigid body and positioned under the user's foot so that the heel plate 10 is able to cover the heel of the user's foot. Due to the rigidity of the toe plate 11 and the heel plate 10, the size adjustment mechanism 13 is able to expand and contract the positioning of the toe plate 11 and the heel plate 10.

In reference to FIG. 1-2, the upper 1 comprises a toe end 2, a heel end 3, an expandable middle section 4, and a foot opening 5. The toe end 2 and the heel end 3 delineate the two opposite ends of the upper 1 as the toe end 2 is designed to aligned with the user's toe, and the heel end 3 is designed to align with the user's heel. The foot opening 5 is positioned in between the toe end 2 and the heel end 3 so that the user can insert their foot into the upper 1. The heel end 3 and the toe end 2 are oppositely positioned of each other about the expandable middle section 4. More specifically, the heel end 3 is adjacently connected to the expandable middle section 4. The toe end 2 is adjacently connected to the expandable middle section 4 opposite of the heel end 3. Resultantly, the heel end 3, the expandable middle section 4, and the toe end 2 are able to collectively delineate the complete profile of the upper 1. Furthermore, a vamp area of the upper 1 can be integrated with shoelace and eyelet, hook and loop fastener straps, buckle straps, or any other types of industry standard fasteners to tightly secure the upper 1 section around the user's foot. Furthermore, the upper 1 can also be integrated with a tongue, a collar, throat line, or any other type of industry standard shoe features depending on different embodiment of the present invention.

The expandable middle section 4 is made from elastic material so that the upper 1 is able to expand and contract about the expandable middle section 4. More specifically, the heel end 3 is connected to the heel plate 10 so that the heel end 3 is able to expand and contract from the expandable middle section 4 since the size adjustment mechanism 13 is slidably engaged to the heel plate 10. Similarly, the toe end 2 is connected to the toe plate 11 so that the toe end 2 is able to expand and contract from the expandable middle section 4 since the size adjustment mechanism 13 is slidably engaged to the toe plate 11. In other words, the heel end 3 and the toe end 2 function as rigid bodies so that the expandable middle section 4 is able to expand and contract with respect to the operation of the size adjustment mechanism 13.

In reference to FIG. 3, the insole 6 comprises a fixed panel 7 and an access panel 8. The fixed panel 7 is superimposed onto the toe plate 11 so that the toe plate 11 can be protected from outside element. In other words, the fixed panel 7 functions as a protective layer for the toe plate 11 so that the fixed panel 7 can simultaneously and expand and contract with the toe plate 11. The access panel 8 is hingedly connected to the heel plate 10 and functions as a protective cover for the heel plate 10 so that the access panel 8 can simultaneously and expand and contract with the heel plate 10. More specifically, the access panel 8 is terminally connected to the heel plate 10 so that the toe plate 11 and the size adjustment mechanism 13 can be enclosed. Furthermore, the connection between the access panel 8 and the heel plate 10 is preferably positioned adjacent to the heel end 3 so that the access panel 8 can be opened towards the heel end 3 to access the size adjustment mechanism 13. Due to the aesthetical or manufacturing reasons, the access panel 8 may partially cover the toe plate 11.

In reference to FIG. 3, the outer sole 12 is perimetrically connected around the toe plate 11 and the heel plate 10 and provides a protective layer against the ground surface. In order to compensate for the expansion and contraction of the toe plate 11 and the heel plate 10, the outer sole 12 is made from elastic material. Furthermore, the outer sole 12 delineates a singular body and hermetically covers the heel plate 10, the toe plate 11, and the size adjustment mechanism 13 to prevent any types of foreign elements.

Figure 5:
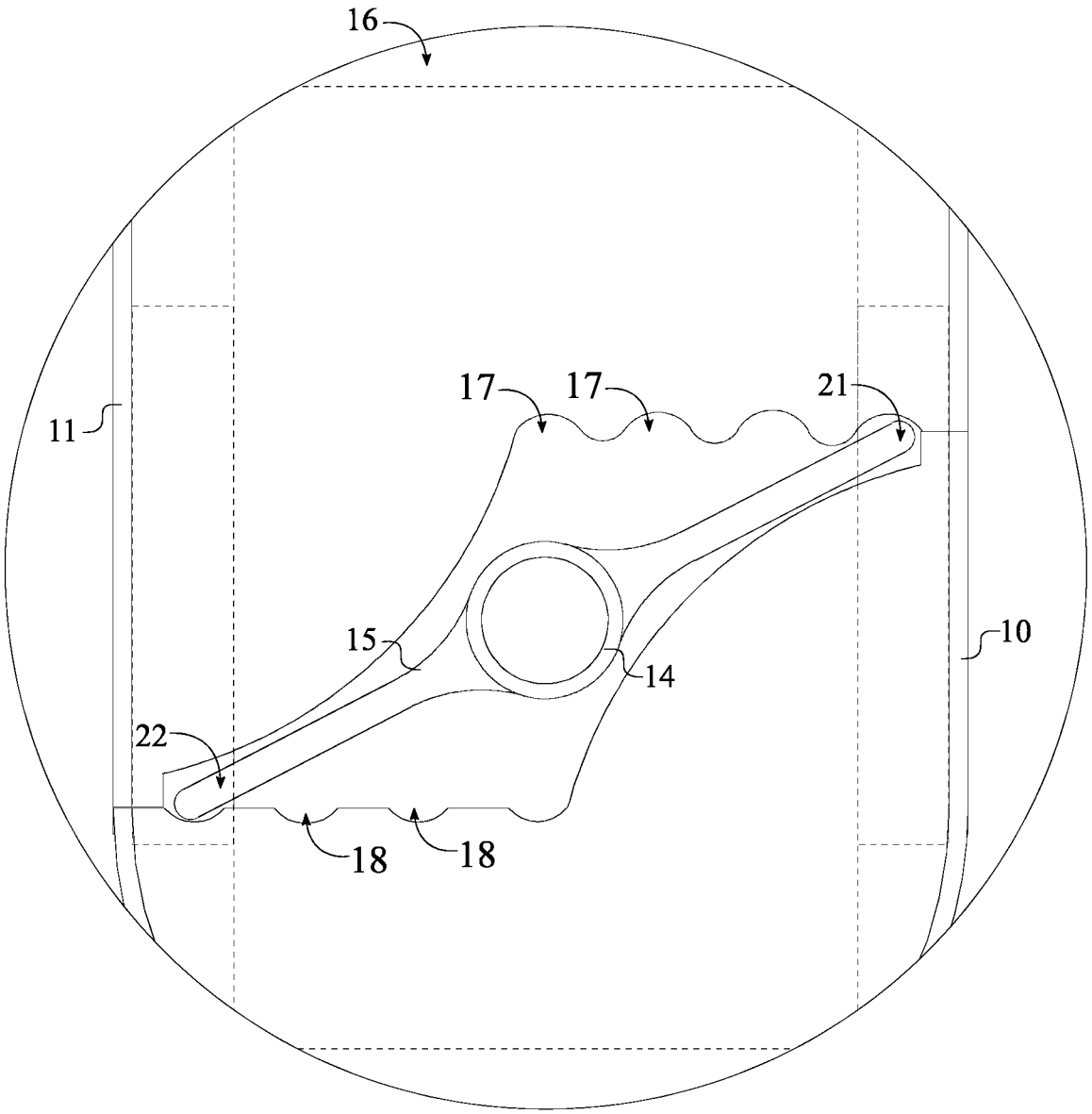
FIG. 5 is a top detailed view of the midsole and the size adjustment mechanism of the present invention, wherein the size adjustment mechanism is at the fourth expanded configuration.
Figure 6:
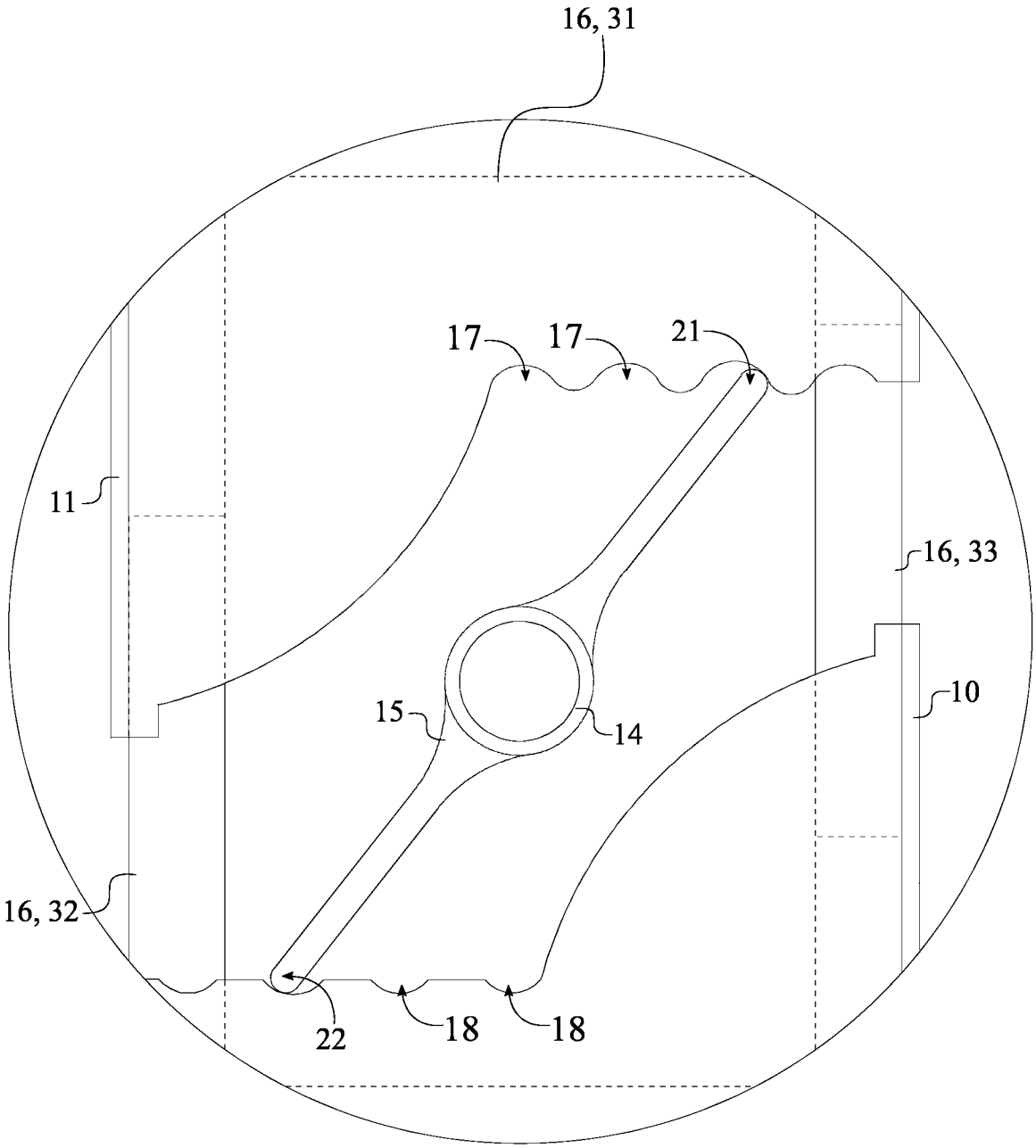
FIG. 6 is a top detailed view of the midsole and the size adjustment mechanism of the present invention, wherein the size adjustment mechanism is at the third expanded configuration.

In reference to FIG. 5, the size adjustment mechanism 13 comprises a dial 14, at least one linear rod 15, a base plate 16, a plurality of first cavities 17, and a plurality of second cavities 18. More specifically, the at least one linear rod 15 is concentrically connected to the dial 14 so that the dial 14 is able to rotatably adjust the positioning of the at least one linear rod 15. The dial 14 is rotatably connected onto the base plate 16 through the at least one linear rod 15 so that the dial 14 and the at least one linear rod 15 can rotate about the base plate 16. The base plate 16 functions as a stationary body for the size adjustment mechanism 13 and slidably connected to the heel plate 10 and the toe plate 11. The base plate 16 can further comprise a medial guide 32, a lateral guide 33, and a main body 31 as shown in FIG. 6-8. The medial guide 32 and the lateral guide 33 are oppositely positioned of each other about the main body 31 to ensure parallel movement of the toe plate 11 and the heel plate 10. More specifically, the medial guide 32 is laterally connected to the main body 31 and slidably engaged with the toe plate 11 and the heel plate 10 to ensure the linear motion of the toe plate 11 and the heel plate 10 with the respect to a medial side of the upper 1 and the expansion and contraction of the size adjustment mechanism 13. The lateral guide 33 is laterally connected to the main body 31 and slidably engaged with the toe plate 11 and the heel plate 10 to ensure the linear motion of the toe plate 11 and the heel plate 10 with the respect to a lateral side of the upper 1 and the expansion and contraction of the size adjustment mechanism 13.

In order to simultaneously expand and contract the toe plate 11 and the heel plate 10, each of the plurality of first cavities 17 linearly traverses into a free end of the toe plate 11, and each of the plurality of second cavities 18 linearly traverses into a free end of the heel plate 10. In other words, the plurality of first cavities 17 and the plurality of second cavities 18 are positioned parallel to each other and oriented toward each other. In reference to FIG. 5-8, each of the plurality of first cavities 17 functions as an engagement cavity for the at least one linear rod 15 so that the positioning of the at least one linear rod 15 can expand and contract the toe plate 11. More specifically, a first end 21 of the at least one linear rod 15 is tensionably engaged with a first corresponding opening from the plurality of first cavities 17 so that the toe plate 11 can be expanded or contracted with respect to the base plate 16. In reference to FIG. 5-8, each of the plurality of second cavities 18 functions as an engagement cavity for the at least one linear rod 15 so that the positioning of the at least one linear rod 15 can expand and contract the heel plate 10. More specifically, a second end 22 of the at least one linear rod 15 is tensionably engaged with a second corresponding opening from the plurality of second cavities 18 so that the heel plate 10 can be expanded or contracted with respect to the base plate 16. In order to make sure that the heel plate 10 and the toe plate 11 are simultaneously expanded and contract about the base plate 16, the first corresponding opening and the second corresponding opening are diametrically opposed of each other about the dial 14.

In the preferred embodiment of the size adjustment mechanism 13, the plurality of first cavities 17 comprises a first toe cavity, a second toe cavity, a third toe cavity, and a fourth toe cavity. The plurality of second cavities 18 comprises a first heel cavity, a second heel cavity, a third heel cavity, and a fourth heel cavity. The first toe cavity and the first heel cavity are positioned along a sagittal plane of the present invention. When the first end 21 is engaged with the first toe cavity and the second end 22 is engaged with the first heel cavity, a first distance between the toe plate 11 and the heel plate 10 is at its highest and delineates a first expanded configuration as shown in FIG. 8. The second toe cavity is adjacently positioned to the first toe cavity and linearly oriented toward the lateral side of the upper 1. The second heel cavity is adjacently positioned to the first heel cavity and linearly oriented toward the medial side of the upper 1. When the first end 21 is engaged with the second toe cavity and the second end 22 is engaged with the second heel cavity, a second distance between the toe plate 11 and the heel plate 10 is slightly lower than the first expanded configuration and delineates a second expanded configuration as shown in FIG. 7. The third toe cavity is adjacently positioned to the second toe cavity and linearly oriented toward the lateral side of the upper 1. The third heel cavity is adjacently positioned to the second heel cavity and linearly oriented toward the medial side of the upper 1. In other words, the second toe cavity is positioned in between the first toe cavity and the third toe cavity. The second heel cavity is positioned in between the first heel cavity and the third heel cavity. When the first end 21 is engaged with the third toe cavity and the second end 22 is engaged with the third heel cavity, a third distance between the toe plate 11 and the heel plate 10 is slightly lower than the second expanded configuration and delineates a third expanded configuration as shown in FIG. 6. The fourth toe cavity is adjacently positioned to the third toe cavity and linearly oriented toward the lateral side of the upper 1. The fourth heel cavity is adjacently positioned to the third heel cavity and linearly oriented toward the medial side of the upper 1. In other words, the third toe cavity is positioned in between the second toe cavity and the fourth toe cavity. The third heel cavity is positioned in between the second heel cavity and the fourth heel cavity. When the first end 21 is engaged with the fourth toe cavity and the second end 22 is engaged with the fourth heel cavity, a fourth distance between the toe plate 11 and the heel plate 10 is slightly lower than the third expanded configuration and delineates a fourth expanded configuration as shown in FIG. 5. The fourth expanded configuration can also be identified as the contracted configuration.

Resultantly, the first distance between is larger than the second distance, the second distance is larger than the third distance, and the third distance is larger than the fourth distance. The size adjustment mechanism 13 can further comprise an indicator that is visible through the dial 14 so that the user is able to differentiate and identify the first expanded configuration, the second expanded configuration, the third expanded configuration, and the fourth expanded configuration. For examples, when the size adjustment mechanism 13 is configured to the second expanded configuration, the indicator may display "2" through the dial 14. When the size adjustment mechanism 13 is configured to the third expanded configuration, the indicator may display "3" through the dial 14.

Although the invention has been explained in relation to its preferred embodiment, it is to be understood that many other possible modifications and variations can be made without departing from the spirit and scope of the invention as hereinafter claimed.

What is claimed is:

1. A size adjustable footwear comprising:

an upper;

an insole;

a midsole;

an outer sole;

a size adjustment mechanism;

the midsole comprising a heel plate and a toe plate;

the upper being perimetrically connected around the midsole;

the insole being adjacently connected atop the midsole;

the insole being internally positioned within the upper;

the outer sole being perimetrically connected around the midsole;

the midsole being positioned in between the insole and the outer sole;

the heel plate and the toe plate being slidably engaged to the size adjustment mechanism;

the size adjustment mechanism being operatively integrated in between the heel plate and the toe plate, wherein the size adjustment mechanism elastically expands and contracts the upper, the midsole, and the outer sole; and the size adjustment mechanism comprising a dial, at least one linear rod, a base plate, a plurality of first cavities, and a plurality of second cavities;

the at least one linear rod being concentrically connected to the dial;

the dial being rotatably connected onto the base plate through the at least one linear rod;

each of the plurality of first cavities being linearly traversing into a free end of the toe plate;

each of the plurality of second cavities being linearly traversing into a free end of the heel plate;

the heel plate and the toe plate being slidably connected to the base plate;

a first end of the at least one linear rod being tensionably engaged with a first corresponding opening from the plurality of first cavities;

a second end of the at least one linear rod being tensionably engaged with a second corresponding opening from the plurality of second cavities; and the first corresponding opening and the second corresponding opening being diametrically opposed of each other about the dial.

2. The size adjustable footwear as claimed in claim 1 comprising:

the upper comprising a toe end, a heel end, an expandable middle section, and a foot opening;

the foot opening being positioned in between the toe end and the heel end;

the heel end and the toe end being oppositely positioned of each other about the expandable middle section;

the heel end being adjacently connected to the expandable middle section; and the toe end being adjacently connected to the expandable middle section.

3. The size adjustable footwear as claimed in claim 2 comprising:

the heel end being adjacently connected to the heel plate; and the toe end being adjacently connected to the toe plate.

4. The size adjustable footwear as claimed in claim 1 comprising:

the insole comprising a fixed panel and an access panel;

the fixed panel being superimposed onto the toe plate;

the access panel being hingedly connected to the heel plate; and the heel plate and the size adjustment mechanism being enclosed by the access panel.

5. The size adjustable footwear as claimed in claim 1, wherein an expandable middle section of the upper is made from elastic material.

6. The size adjustable footwear as claimed in claim 1, wherein the outer sole is made from elastic material.

7. The size adjustable footwear as claimed in claim 1 comprising:

the base plate comprising a main body, a medial guide, and a lateral guide;

the medial guide and the lateral guide being oppositely positioned of each other about the main body;

the medial guide being laterally connected to the main body;

the lateral guide being laterally connected to the main body;

the medial guide being slidably engaged with the toe plate and the heel plate; and the lateral guide being slidably engaged with the toe plate and the heel plate.

* * * * *